United States Patent [19]

Drower

[11] Patent Number: 4,570,866

[45] Date of Patent: Feb. 18, 1986

[54] LINE RETRACTOR

[75] Inventor: Herbert M. Drower, Wilmette, Ill.

[73] Assignee: Sealtran Corporation, Chicago, Ill.

[21] Appl. No.: 721,160

[22] Filed: Apr. 8, 1985

[51] Int. Cl.[4] ..... B65H 75/36

[52] U.S. Cl. ..... 242/47.5; 191/12 R; 267/69

[58] Field of Search ..... 242/47.5, 55.01, 129.1; 191/12 R, 12 S; 267/69; 137/355.16, 355.2, 355.23, 355.24

[56] References Cited

U.S. PATENT DOCUMENTS

| | | | |
|---|---|---|---|
| 457,220 | 8/1891 | Schmidt | 242/107 |
| 588,378 | 8/1897 | Bean et al. | 242/47.5 |
| 1,213,360 | 1/1917 | Hart | 191/44 |
| 1,384,153 | 7/1921 | Roos | 242/47.5 |
| 1,518,881 | 12/1924 | Walker et al. | 242/47.5 X |
| 2,280,680 | 4/1942 | Wittman | 242/47.5 X |
| 2,364,081 | 12/1944 | Lambert | 267/69 |
| 2,482,851 | 9/1949 | Jennewein | 242/47.5 X |
| 2,837,292 | 6/1958 | Adamson | 242/47.5 |
| 3,869,114 | 3/1975 | Schneider | 267/69 |
| 4,174,816 | 11/1979 | Olson | 242/47.5 |

*Primary Examiner*—Stanley N. Gilreath

*Attorney, Agent, or Firm*—Kinzer, Plyer, Dorn & McEachran

[57] ABSTRACT

A retractor for storage of a long, flexible line includes a thin, flat, elongated strip spring member of tough, resilient, inelastic resin, preferably an oriented polyester resin such as polyethylene terephthalate, the spring having an arcuate configuration exceeding 180° up to a full 360°. A plurality of small pulleys mounted on the spring member project inwardly thereof at spaced locations with half of the pulleys located on each side of a centerline. The line is anchored to the spring member near one end of the centerline and extends back and forth across the centerline around each pulley to store a substantial length of the line within the spring member.

15 Claims, 5 Drawing Figures

LINE RETRACTOR

BACKGROUND OF THE INVENTION

There are numerous applications for a line retractor capable of storing a long, flexible line. One example is in a small, portable appliance that requires connection to a power source through an external electrical line. Another example is a sash cord or other cord of like nature. Other examples are a vertically movable light fixture or a telephone receiver cord.

A variety of different devices have been employed for storage and retraction of lines of various kinds. For the most part, these devices have been undesirably large in size, overly heavy in weight, or unduly expensive and complex. Indeed, many prior art devices have exhibited a combination of these disadvantages. Another difficulty with many prior art devices is excessive frictional drag experienced when the line is pulled out of storage in the retractor or is released for retraction back to the storage condition.

SUMMARY OF THE INVENTION

It is a principal object of the invention, therefore, to provide a new and improved line retractor for storage of a long, flexible line, a retractor that is sufficiently compact to store a substantial length of line in a small space, that is light in weight, and that has minimum frictional drag for extension or retraction of the line.

Another object of the invention is to provide a new and improved line retractor for storage and retraction of a long, flexible line that is simple and inexpensive, light in weight, and affords an extended operational life.

Accordingly, the invention relates to a line retractor for storage and retraction of a long, flexible line, comprising a thin, flat, elongated strip spring member of tough, resilient, inelastic resin material having an arcuate configuration exceeding 180°. A plurality of pulleys are mounted on the spring member and project inwardly thereof at spaced locations, with all pulleys aligned in a common plane transverse to the spring member and with approximately equal numbers of the pulleys located on opposite sides of a centerline through the spring member. Line anchor means are provided to anchor a line to the spring member adjacent one end of the centerline, the line being extended from the anchor means back and forth across the centerline and around each pulley to store a substantial length of the line within the arc of the spring member.

DESCRIPTION OF THE PREFERRED EMBODIMENTS

Figure 1:
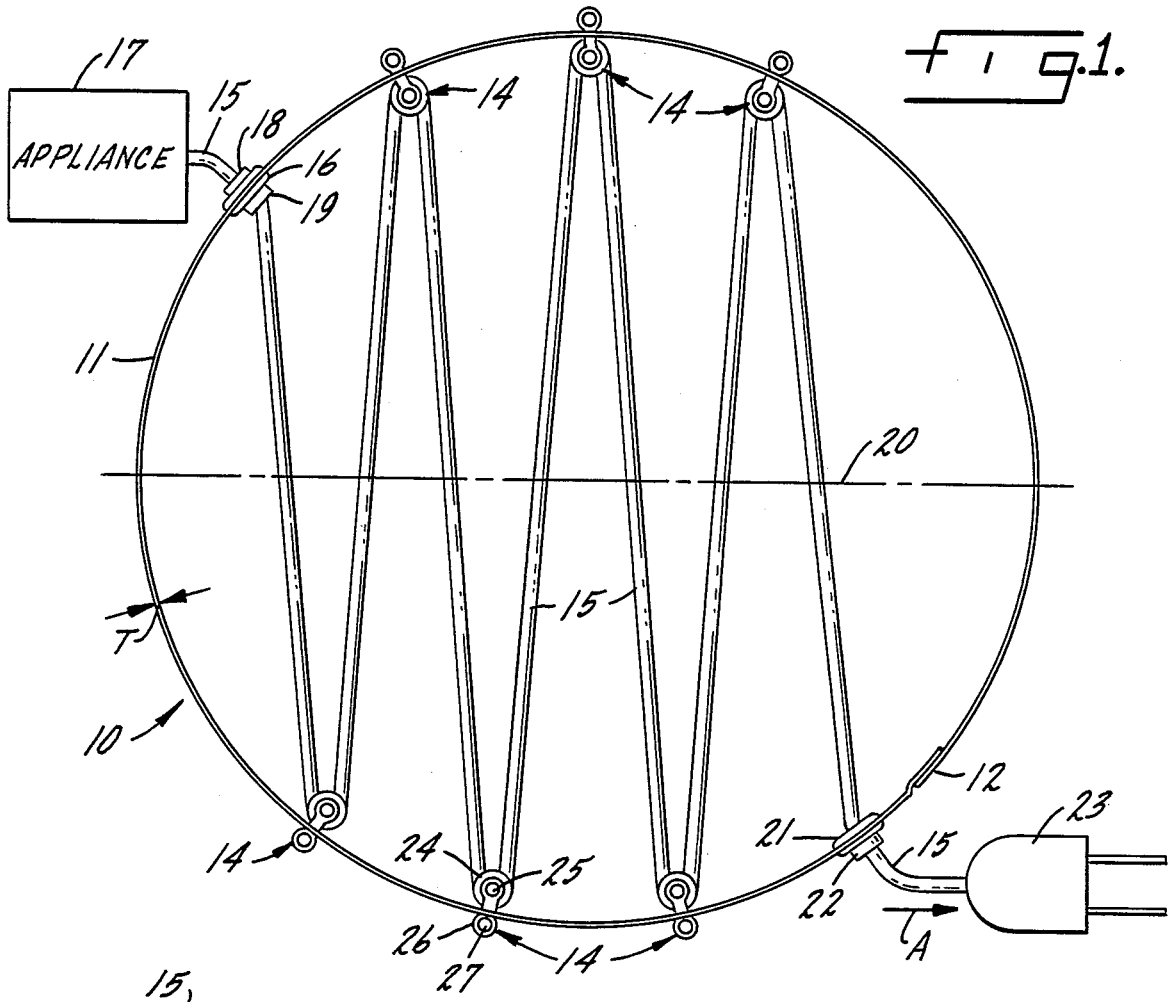
FIG. 1 is a plan view of a line retractor constructed in accordance with one embodiment of the invention, shown in a line storage condition.
Figure 2:
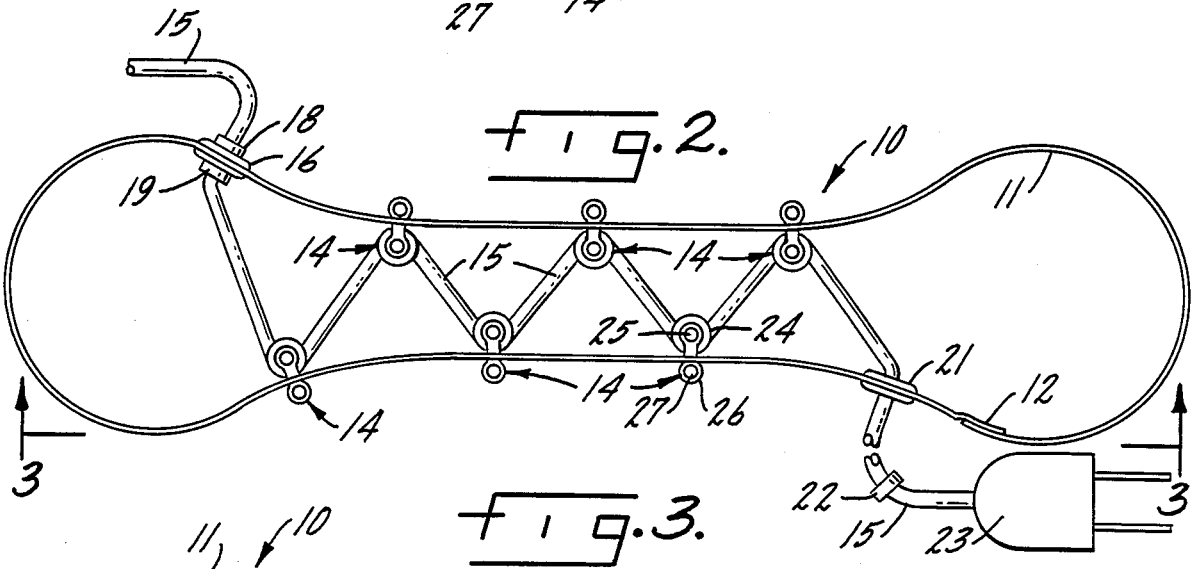
FIG. 2 is a plan view like FIG. 1 but showing the device with the line pulled from the retractor.
Figure 3:
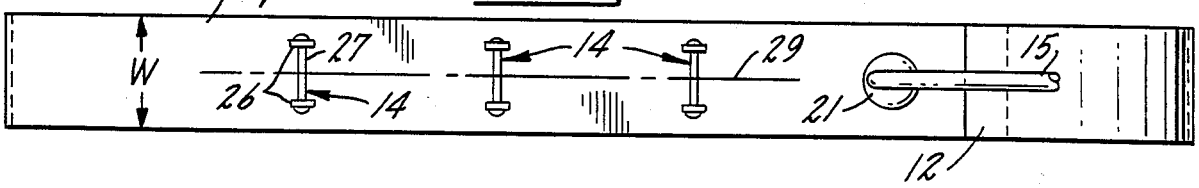
FIG. 3 is a side view taken approximately as indicated by line 3—3 in FIG. 2.

The line retractor 10 illustrated in FIGS. 1-3 comprises an annular spring member 11 formed of a thin, elongated strip of tough, highly resilient but inelastic resin; the strip has its ends sealed to each other as indicated at 12 to form the complete ring 11. Typically, the resin strip utilized to form the resilient spring member 11 may comprise an oriented polyester resin such as polyethylene terephthalate having a thickness T in a range of about 0.010" to 0.060" and a width W of about one-half inch to one inch. Both the thickness T and the width W can be varied to a substantial extent, depending upon the retraction force desired for device 10.

A plurality of small pulleys 14 are mounted on the resilient ring 11 with the roller portion of each pulley 14 projecting into the interior of the ring. Six pulleys 14 are shown in FIGS. 1 and 2 but the number of pulleys can be increased or decreased depending upon the length of a line or cord 15 that is to be stored in the retractor 10. With the construction shown in FIG. 1, a retractor 10 having a diameter of six inches stores a length of line 15 of about thirty inches. Of course, the diameter of the annular spring member 11 can be changed for the same purpose. Half of the pulleys 14 are mounted on one side of a centerline 20 through the annular spring member 11 and the remaining half are on the opposite side of the centerline. If an odd number of pulleys were used, there would be one more pulley on one side of centerline 20 than on the other. All of the pulleys are aligned in a common plane 29 transverse to spring member 11, as shown in FIG. 3.

One end of line 15 extends through an inlet aperture in spring member 11 encompassed by an eyelet 16. In FIG. 1 this end of line 15 is shown connected to an appliance 17. Two stop members 18 and 19 are affixed to line 15 on the outer and inner sides of eyelet 16 so that line 15 is effectively anchored to ring 11 at eyelet 16.

Line 15 extends from eyelet 16 around each of the pulleys 14, back and forth across centerline 20, and out of the spring member 11 through a line exit aperture encompassed by a second eyelet 21. An additional stop member 22 may be affixed to line 15 adjacent the line exit eyelet 21 but outside of the annular member 11 to limit the amount of line that may be retracted into the interior of the spring. That is, line 15 is free to be pulled outwardly of exit eyelet 21 but cannot move further into spring member 11 than the limit imposed by stop member 22. If line 15 is an electrical line, a connection plug 23 on the end of the line may serve double duty as a stop, replacing stop member 22.

When line 15 is pulled outwardly of retractor 10 in the direction indicated by arrow A in FIG. 1, the result is as shown in FIGS. 2 and 3. Most of the length of line 15 that has previously been stored within spring member 11 now extends outwardly beyond the retractor. Thus, in the case of an electrical line for an appliance 17, if plug 23 is inserted into an electrical power receptacle, retractor 10 automatically retracts any slack in the electrical line. If and when plug 23 is removed from the receptacle, the resilience of spring member 11 pulls line 15 back into the interior of retractor 10, with spring member 11 being restored to the circular configuration shown in FIG. 1.

In the construction illustrated in FIGS. 1-3, each pulley 14 includes a roller 24 journalled on a shaft 25, the shaft 25 being mounted between the arms of a bracket 26. The arms of the bracket 26 extend outwardly through spring member 11 and are secured by an appropriate fastener such as a pin 27. This mounting arrangement for pulleys 14 should be considered to be merely exemplary; any other effective mounting for the pulleys can be utilized as desired.

For members 16 and 21, eyelets formed of a metal, such as brass, are preferred. Stop members 18, 19 and 22 may be of any desired type. If line 15 is a simple, non-electrical cord, knots in the cord itself may serve as the stop members.

Retractor 10 affords a simple and effective storage arrangement for a substantial length of line 15 in a minimum space. As previously noted, the width W of ring 11, which constitutes one maximum dimension of retractor 10, may be one-half inch or even somewhat smaller. The diameter of the retractor is dependent upon the length of cord to be stored; it is preferably made as small as possible to afford maximum storage in a minimum space. Using a tough, high quality material of high resilience for ring 11 assures a virtually indefinite operational life for the retractor. The manufacture of retractor 10 is simple and inexpensive, and weight of the retractor is minimal so that it can be added to a portable appliance 17 or other portable device without incurring a weight handicap.

Figure 4:
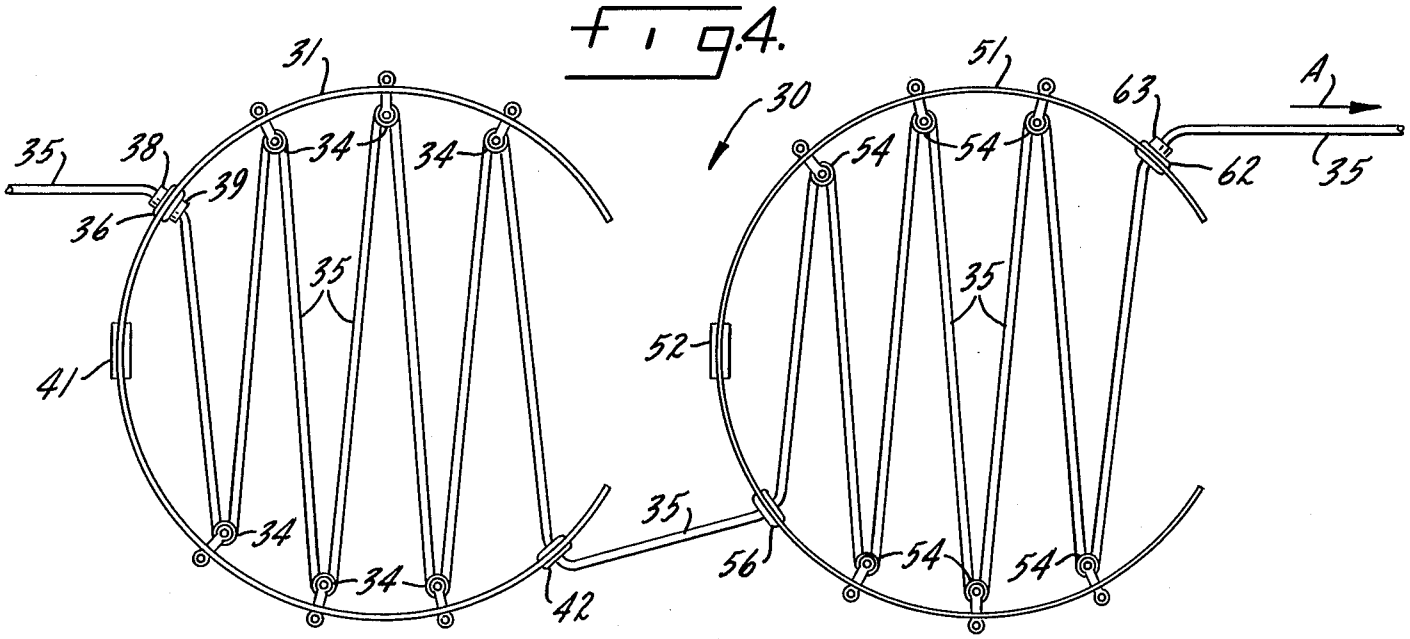
FIG. 4 is a plan view of a line retractor constructed in accordance with another embodiment of the invention, in its storage condition.
Figure 5:
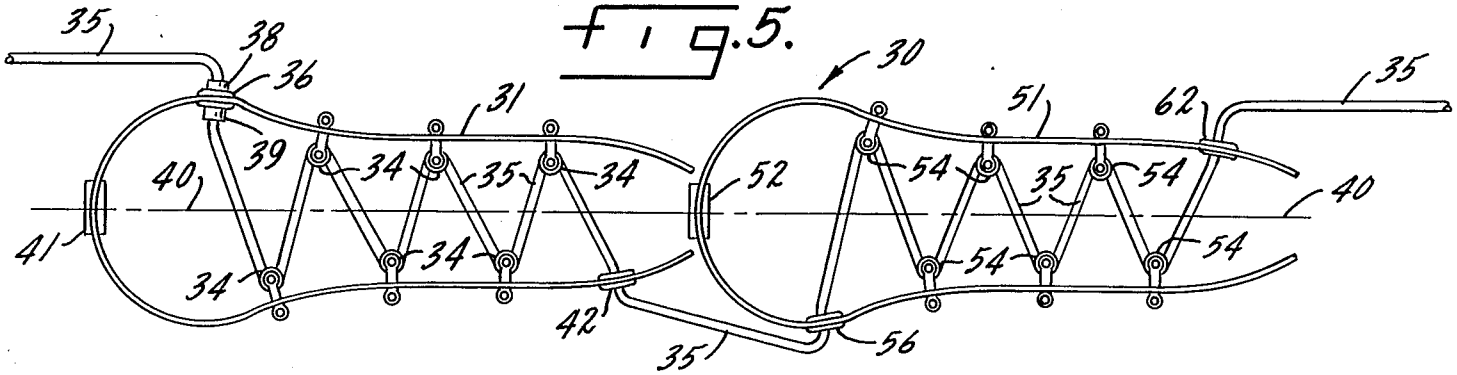
FIG. 5 is a plan view like FIG. 4 but showing the device with the line pulled from the retractor.

FIGS. 4 and 5 illustrate a line retractor device 30 constructed in accordance with a second embodiment of the invention. Retractor 30 is shown in its full storage condition in FIG. 4 whereas FIG. 5 shows the device with most of the stored line pulled out for use.

Retractor 30 includes a first annular spring member 31 formed from an elongated strip of thin, tough, resilient but inelastic resin. A strip of an oriented polyester resin such as polyethylene terephthalate is preferred. As before, spring member 31 may have a thickness in a range of about 0.010" to 0.060" and a width, in a direction perpendicular to the plane of the drawing, of about one-half to one inch. Spring 31 is not completely circular, like the spring member 11 in the embodment of FIGS. 1–3. Instead, it has an arcuate configuration of approximately 300°.

A plurality of small pulleys 34 are anchored to the arcuate spring member 31 with the roller portion of each pulley projecting toward the interior of the spring. Half of the pulleys are mounted on each side of a centerline 40 for spring member 31. As before, if an odd number of pulleys were used, there would be one more pulley on one side of centerline 40 than on the other. All pulleys 34 are aligned in a common plane, as in the previously described embodiment. A line or cord 35 extends into the interior of the spring 31 through an eyelet 36. Stop members 38 and 39 affixed to line 35 on opposite sides of eyelet 36 effectively anchor cord 35 to spring member 31 at the eyelet. A mounting member 41 is provided to mount spring 31 in fixed position on an appropriate base (not shown).

Line 35 extends around each of the pulleys 34, back and forth across centerline 40, and outwardly of the spring member 31 through an exit opening encompassed by an eyelet 42. There are no stop members on this portion of the line. That is, the cord or line 35 passes unimpeded through eyelet 42.

Retractor 30 further includes a second arcuate spring member 51 that has the same construction as member 31. Spring 51 is anchored to the same base as spring 31 by an appropriate mounting member 52. A plurality of small pulleys 54 are mounted on spring 51 with each pulley having its roller extending into the interior of the extended arc formed by the spring.

Line 35 extends from eyelet 42 on spring 31 through an eyelet 56 mounted in spring 51 and into the interior of the second spring member. As in the case of eyelet 42, movement of line 35 through eyelet 56 is unimpeded by any stop members on the line. Line 35 is then trained around each of the pulleys 54, back and forth across centerline 40, and extends outwardly of spring 51 through an exit opening encompassed by an eyelet 62. A stop member 63 may be affixed to line 35 to limit retraction of the line into device 30.

When line 35 is pulled outwardly of retractor 30 in the direction indicated by the arrow A in FIG. 4, spring 51 is first pulled into the stressed configuration shown in FIG. 5. As the line is pulled further from retractor 30, additional increments of length of the cord are pulled out of spring 31, flattening that spring to the configuration shown in FIG. 5. Subsequently, if line 35 is released, the resilience of the two spring members 31 and 51 pull the line back into storage within the two springs in the condition illustrated in FIG. 4.

Like retractor 10, retractor 30 is simple, light in weight, and inexpensive in construction; it stores a substantial length of line 35 in a compact space. Operating life is of indefinite duration, and the retraction operation is highly reliable. Both retractors minimize internal friction drag on the stored line, during either pull out or retraction, due to the alignment of the pulleys in each retractor, in a common plane transverse to the retractor spring member.

I claim:

1. A line retractor for storage and retraction of a long, flexible line, comprising:

a thin, flat, elongated strip spring member of tough, resilient, inelastic resin material having an arcuate configuration exceeding 180°;

a plurality of pulleys mounted on the spring member and projecting inwardly thereof at spaced locations, with all pulleys aligned in a common plane transverse to the spring member and with approximately equal numbers of the pulleys located on opposite sides of a centerline through the spring member; and line anchor means to anchor a line to the spring member adjacent one end of the centerline, the line being extended from the anchor means back and forth across the centerline and around each pulley to store a substantial length of the line within the arc of the spring member.

2. A line retractor according to claim 1 in which the spring member includes a line exit aperture, through the spring member, on the side of the centerline opposite the pulley spaced farthest from the line anchor means.

3. A line retractor according to claim 2 in which the line anchor means comprises a line entry aperture through the spring member and two stop members affixed to the line, adjacent the entry aperture, on opposite sides of the spring member.

4. A line retractor according to claim 3 in which the anchor means includes a first metal eyelet affixed to the spring member in encompassing relation to the line entry aperture, and further comprising a second metal eyelet affixed to the spring member in encompassing relation to the line exit aperture.

5. A line retractor according to claim 4 in which the spring member is of closed, annular configuration.

6. A line retractor according to claim 1 in which the spring member is formed of a strip of oriented polyethylene terephthalate.

7. A line retractor according to claim 6 in which the spring member includes a line exit aperture, through the spring member, on the side of the centerline opposite the pulley spaced farthest from the line anchor means.

8. A line retractor according to claim 7 in which the line anchor means comprises a line entry aperture through the spring member and two stop members affixed to the line, adjacent the entry aperture, on opposite sides of the spring member.

9. A line retractor according to claim 8 in which the anchor means includes a first metal eyelet affixed to the spring member in encompassing relation to the line entry aperture, and further comprising a second metal eyelet affixed to the spring member in encompassing relation to the line exit aperture.

10. A line retractor according to claim 9 in which the spring member is of closed, annular configuration.

11. A line retractor according to claim 1 in which the spring member is of closed, annular configuration, and in which the spring member includes a line exit aperture, through the spring member, on the side of the centerline opplosite the pulley spaced farthest from the line anchor means.

12. A line retractor according to claim 11 in which the line anchor means comprises a line entry aperture through the spring member and two stop members affixed to the line, adjacent the entry aperture, on opposite sides of the spring member.

13. A line retractor for storage and retraction of a long, flexible line, comprising:

first and second thin, flat, elongated strip spring members each formed of tough, resilient, inelastic resin material and each having an arcuate configuration exceeding 180°;

a plurality of pulleys mounted on each spring member and projecting inwardly thereof at spaced locations, with all pulleys on each spring member aligned in a common lane transverse to the spring member and with approximately equal numbers of the pulleys located on opposite sides of a centerline through each spring member;

line anchor means to anchor a line to the first spring member adjacent one end of its centerline, the line being extended from the anchor means back and forth across the centerline and around each pulley to store a substantial length of the line within the arc of the first spring member;

a line exit aperture in the first spring member, on the side of its centerline opposite the pulley spaced farthest from the line anchor means;

a line entry aperture in the second spring member adjacent one end of the centerline;

the line being extended out through the exit aperture in the first spring member and in through the entry aperture in the second spring member and back and forth across the centerline of the second spring member around each pulley;

and a line exit aperture in the second spring member on the side of its centerline opposite the pulley spaced farthest from its entry aperture.

14. A line retractor according to claim 13 in which each line entry and exit aperture is encompassed by a metal eyelet.

15. A line retractor according to claim 13 in which each spring member is formed from a strip of an oriented polyester resin.

* * * * *